US008931572B2

(12) United States Patent
Nakata et al.

(10) Patent No.: US 8,931,572 B2
(45) Date of Patent: Jan. 13, 2015

(54) WORK MACHINE AND AUTOMATIC CONTROL METHOD FOR BLADE OF WORK MACHINE

(71) Applicant: Komatsu Ltd., Tokyo (JP)

(72) Inventors: Kazushi Nakata, Komatsu (JP); Shigeru Yamamoto, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/131,700

(22) PCT Filed: Jun. 12, 2013

(86) PCT No.: PCT/JP2013/066214
§ 371 (c)(1),
(2) Date: Jan. 9, 2014

(87) PCT Pub. No.: WO2014/024562
PCT Pub. Date: Feb. 13, 2014

(65) Prior Publication Data

US 2014/0345889 A1 Nov. 27, 2014

(30) Foreign Application Priority Data

Aug. 6, 2012 (JP) ..... 2012-174436

(51) Int. Cl.
*E02F 9/22* (2006.01)
*E02F 3/84* (2006.01)
*E02F 3/76* (2006.01)

(52) U.S. Cl.
CPC ..... *E02F 3/844* (2013.01); *E02F 3/7613* (2013.01); *E02F 3/7618* (2013.01)
USPC ..... 172/4.5; 172/260.5; 172/779; 172/819; 701/50

(58) Field of Classification Search
USPC ..... 172/4.5, 260.5, 663, 779, 812, 819; 701/50
See application file for complete search history.

(56) References Cited

U.S. PATENT DOCUMENTS 5,487,428 A * 1/1996 Yamamoto et al. ..... 172/4.5
5,499,684 A * 3/1996 Stratton ..... 172/4.5

(Continued)

FOREIGN PATENT DOCUMENTS

JP 55-105036 A 8/1980
JP 2001-107385 A 4/2001

OTHER PUBLICATIONS

International Search Report for the international application No. PCT/JP2012/066214, issued on Sep. 17, 2013.

*Primary Examiner* — Gary Hartmann
(74) *Attorney, Agent, or Firm* — Global IP Counselors, LLP

(57) ABSTRACT

A work machine includes a vehicle body, a blade supported by the vehicle body, a pair of first hydraulic cylinders, a pair of second hydraulic cylinders, a pair of lift stroke sensors and a control unit. The first hydraulic cylinders are configured to lower and raise the blade. The second hydraulic cylinders are configured to tilt the blade forward and backward and left and right. The lift stroke sensors are configured to detect stroke amounts from the pair of first hydraulic cylinders, respectively. The control unit is configured to start actuating the pair of second hydraulic cylinders when the stroke amounts of the pair of first hydraulic cylinders match. The control unit is configured to stop actuating the pair of second hydraulic cylinders based on a magnitude relation between a prescribed threshold and a difference in the stroke amounts of the pair of first hydraulic cylinders.

5 Claims, 9 Drawing Sheets

(56) References Cited

U.S. PATENT DOCUMENTS

| | | | | | |
|---|---|---|---|---|---|
| 5,816,335 | A | * | 10/1998 | Yamamoto et al. | 172/4.5 |
| 5,819,190 | A | * | 10/1998 | Nakagami et al. | 701/50 |
| 5,878,854 | A | * | 3/1999 | Siessl et al. | 191/59.1 |
| 5,984,018 | A | * | 11/1999 | Yamamoto et al. | 172/2 |
| 5,996,703 | A | * | 12/1999 | Yamamoto et al. | 172/4.5 |
| 6,035,241 | A | * | 3/2000 | Yamamoto | 700/40 |
| 6,062,317 | A | | 5/2000 | Gharsalli et al. | |
| 6,129,158 | A | * | 10/2000 | Yamamoto et al. | 172/812 |
| 6,181,999 | B1 | * | 1/2001 | Yamamoto et al. | 701/50 |
| 6,282,453 | B1 | * | 8/2001 | Lombardi | 700/63 |
| 7,059,124 | B2 | * | 6/2006 | Suzuki et al. | 60/421 |
| 8,103,417 | B2 | * | 1/2012 | Gharsalli et al. | 701/50 |
| 2005/0065689 | A1 | | 3/2005 | Budde et al. | |

* cited by examiner

WORK MACHINE AND AUTOMATIC CONTROL METHOD FOR BLADE OF WORK MACHINE

CROSS-REFERENCE TO RELATED APPLICATIONS

This application is a U.S. National stage application of International Application No. PCT/JP2013/066214, filed on Jun. 12, 2013. This U.S. National stage application claims priority under 35 U.S.C. §119(a) to Japanese Patent Application No. 2012-174436, filed in Japan on Aug. 6, 2012, the entire contents of which are hereby incorporated herein by reference.

FIELD OF THE INVENTION

The present invention relates to a work machine provided with a blade and an automatic control method for the blade of the same.

BACKGROUND INFORMATION

A work machine such as a bulldozer or a motor grader is equipped with a blade as work implement for excavating earth.

US Patent Application Publication No. 2005/0065689 discloses a work machine equipped with a pair of lift cylinders for lowering and raising the blade, and a pair of pitch/tilt cylinders for pitching the blade forward and backward. The work machine of US Patent Application Publication No. 2005/0065689 is able to recognize the blade attitude on the basis of detection values from four stroke sensors for detecting stroke amounts of the lift cylinders and the pitch/tilt cylinders.

The blade can be tilted forward and backward and left and right by actuating one or both of the pair of pitch/tilt cylinders in the work machine of US 2005/0065689.

SUMMARY

Since stroke sensors are generally expensive, there is a desire to recognize the blade attitude with, for example, only two stroke sensors for detecting the stroke amount of the pair of lift cylinders.

However, the degree of the tilt of the blade forward, backward, left or right cannot be recognized on the basis of only the stroke amount of the pair of lift cylinders. As a result, excavation work cannot be conducted effectively if excavation work is conducted without controlling the attitude of the blade.

Specifically, even if the blade is lifted to a standard height, the cutting edge of the blade may dig into the ground surface and excavate too much earth if the blade is pitched forward too much. Conversely, even when the blade is lifted to the standard height, the cutting edge may be too far removed from the ground surface so that not enough earth is excavated if the blade is pitched backward too much.

In consideration of the above condition, an object of the present invention is to provide a work machine that allows automatic control for reference attitudes of the blade attitude on the basis of the stroke amount of a pair of lift cylinders, and an automatic control method for a blade on the work machine.

A work machine according to a first embodiment is equipped with a vehicle body, a blade supported by the vehicle body, a pair of first hydraulic cylinders, a pair of second hydraulic cylinders, a pair of lift stroke sensors, and a control unit. The pair of first hydraulic cylinders is configured to lower and raise the blade. The pair of second hydraulic cylinders is configured to tilt the blade forward and backward and left and right. The pair of lift stroke sensors is configured to detect stroke amounts from each of the pair of first hydraulic cylinders. The control unit is configured to start actuating the pair of second hydraulic cylinders when the stroke amounts of the pair of first hydraulic cylinders match. The control unit is configured to stop actuating the pair of second hydraulic cylinders on the basis of a magnitude relation between a prescribed threshold and a difference in the stroke amounts of the pair of first hydraulic cylinders.

Based on the work machine according to the first embodiment, a reference attitude of the blade can be restored by actuating the pair of second hydraulic cylinders using only the pair of lift stroke sensors. As a result, the edge of the blade excessively digging into the ground surface or the edge of the blade being too far removed from the ground surface can be suppressed. Consequently, excavation work can be executed effectively.

The work machine according to a second embodiment is related to the first embodiment. The pair of second hydraulic cylinders includes a pitch cylinder configured to pitch the blade forward and backward, and a pitch/tilt cylinder configured to tilt the blade forward and backward and left and right. The maximum stroke length of the pitch cylinder is shorter than the maximum stroke length of the pitch/tilt cylinder. The control unit stops actuating the pair of second hydraulic cylinders when the control unit has determined that the difference between the stroke amounts of the pair of first hydraulic cylinders has become larger than the prescribed threshold while the pair of second hydraulic cylinders are being actuated at a same speed.

The work machine according to a third embodiment is related to the first embodiment. The pair of second hydraulic cylinders includes a pitch cylinder configured to pitch the blade forward and backward, and a pitch/tilt cylinder configured to tilt the blade forward and backward and left and right. The maximum stroke length of the pitch cylinder is the same as the maximum stroke length of the pitch/tilt cylinder. The control unit stops actuating the pair of second hydraulic cylinders when the control unit has determined that the difference between the stroke amounts of the pair of first hydraulic cylinders has become smaller than the prescribed threshold while the pair of second hydraulic cylinders are being actuated at different speeds.

The blade is lowered and raised by the pair of first hydraulic cylinders in an automatic control method for the blade on a work machine according to a fourth embodiment. The automatic control method of the blade includes detecting positions of the pair of first hydraulic cylinders, comparing the detected positions of the pair of first hydraulic cylinders, tilting the blade until the pair of first hydraulic cylinders becomes parallel, and pitching the blade until the pair of first hydraulic cylinders becomes non-parallel after the blade has been tilted until the pair of first hydraulic cylinders becomes parallel.

Based on the automatic control method of the blade on the work machine according to the fourth embodiment, the blade is tilted (tilting action in left-right direction) until the positions of the pair of first hydraulic cylinders are parallel, that is until the blade reaches a horizontal position in the right-left direction. Next, the pitch (tilting action in the front-back direction) of the blade is changed until the positions of the pair of first hydraulic cylinders are shifted. In other words, the limit of the allowable pitch action is determined by the positions of the pair of first hydraulic cylinders, and the pitch is changed up to that limit. According to this action, the blade can be moved horizontally in the left-right direction to the allowable limit of the pitch action by comparing the positions of the pair of first hydraulic cylinders.

The blade is lowered and raised by the pair of first hydraulic cylinders and tilted forward and backward and left and right by the pair of second hydraulic cylinders in an automatic control method of the blade on a work machine according to a fifth embodiment. The automatic control method for the blade includes detecting positions of the pair of first hydraulic cylinders, comparing the detected positions of the pair of first hydraulic cylinders, tilting the blade until the pair of first hydraulic cylinders becomes parallel, and stopping the pair of second hydraulic cylinders when the pair of first hydraulic cylinders has become parallel again while the pair of second hydraulic cylinders are being actuated at different speeds after the blade has been tilted until the pair of first hydraulic cylinders becomes parallel.

Based on the automatic control method of the blade on the work machine according to the fifth embodiment, blade is tilted the (tilting action in left-right direction) to a point where the positions of the pair of first hydraulic cylinders are parallel, that is a point where the blade reaches a horizontal position in the right-left direction. Next, after actuating the pair of second hydraulic cylinders at different speeds, the actuation of the second hydraulic cylinders is terminated when the positions of the first hydraulic cylinders are the same again. According to this action, the blade can be moved horizontally in the left-right direction to the allowable limit position of the second hydraulic cylinder action by comparing the positions of the pair of first hydraulic cylinders.

According to the present invention, a work machine that allows automatic control for reference attitudes of the blade attitude on the basis of the stroke amount of the pair of first hydraulic cylinders, and an automatic control method for the blade on the work machine are provided.

DETAILED DESCRIPTION OF EMBODIMENTS

The following is a discussion of a bulldozer as an example of a "work machine" with reference to the drawings. In the following description, "up," "down," "front," "back," "left," and "right" are terms used on the basis of an operator sitting in the driver's seat.

First Embodiment

Configuration of Bulldozer 100

Figure 1:
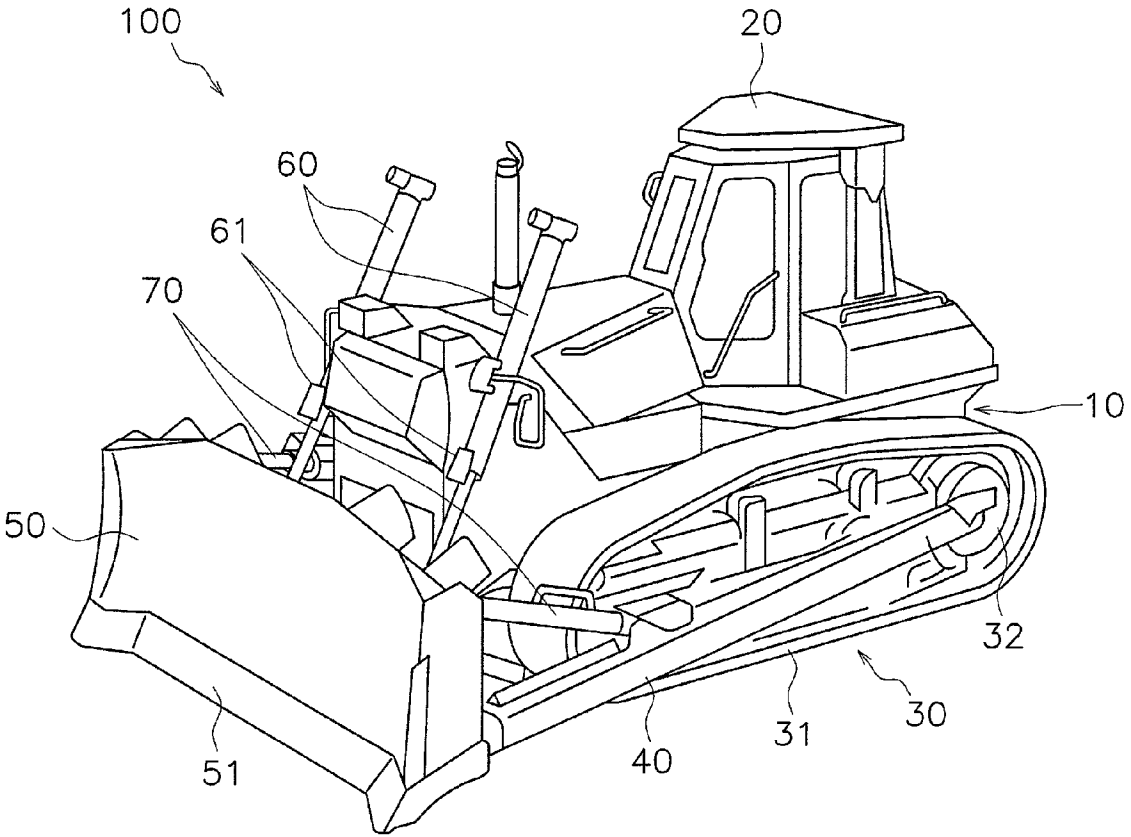
FIG. 1 is a front perspective view of a configuration of a bulldozer according to a first embodiment.
Figure 2:
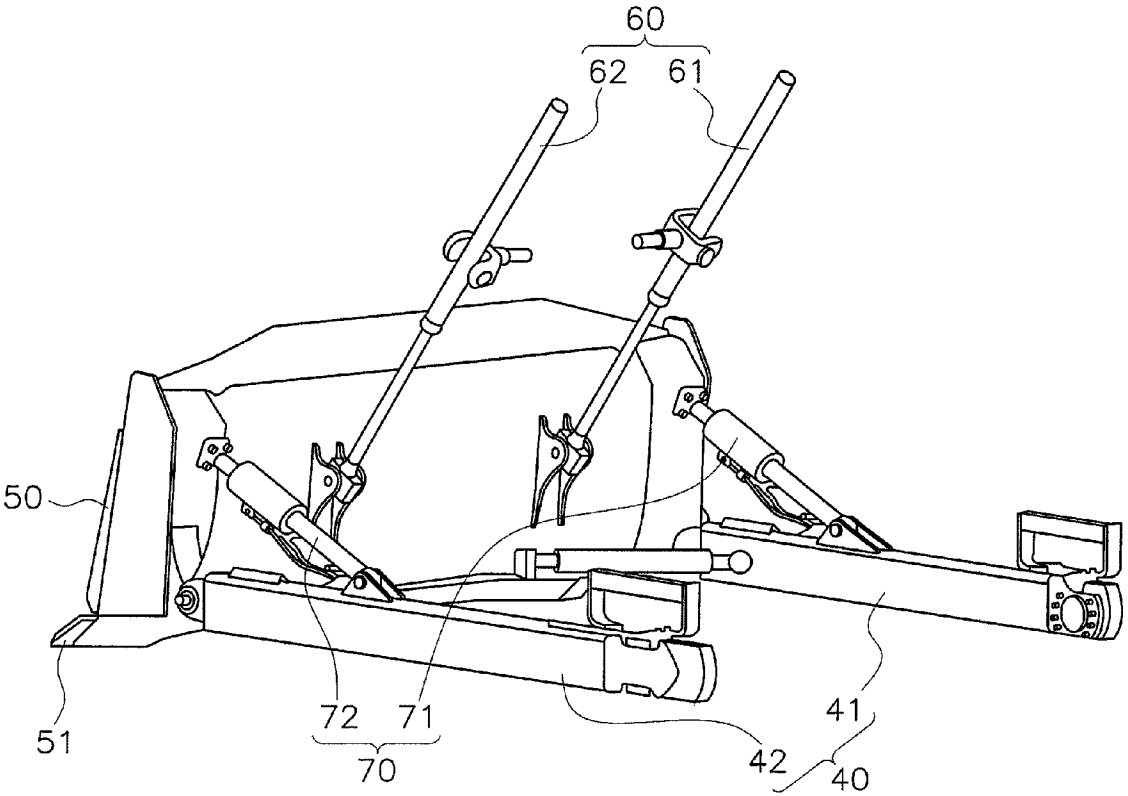
FIG. 2 is a rear perspective view of a configuration of an actuation system for a blade according to a first embodiment.

FIG. 1 is a front perspective view of a configuration of a bulldozer 100. FIG. 2 is a rear perspective view of a configuration of an actuation system for a blade 50.

The bulldozer 100 is equipped with a vehicle body 10, a cab 20, a travel device 30, a pair of lift frames 40, the blade 50, a pair of lift cylinders (first hydraulic cylinders) 60, and a pair of pitch/tilt cylinders (second hydraulic cylinders) 70. The bulldozer 100 includes a blade control system 200 (see FIG. 4) for automatically controlling an attitude of the blade 50. The blade control system 200 will be discussed below.

The vehicle body 10 supports the cab 20. The vehicle body 10 is supported by the travel device 30. The cab 20 includes a driver's seat for an operator to sit in, and pedals and levers for operating the travel device 30 and the blade 50. In particular, a blade attitude restore button 210 (see FIG. 4) for restoring the attitude of the blade 50 to a reference attitude is provided in the cab 20. The operator presses the blade attitude restore button 220 for restoring the blade 50 to the reference attitude while reversing the bulldozer 100 to a starting position after completing one pass of excavation or grading by the blade 50 while advancing the bulldozer 100. The reference attitude of the blade 50 signifies an attitude of the blade 50 having a certain inclination forward or backward but not having any inclination to the left or right at a certain height above the ground surface. In the present embodiment, the inclination in the front-back direction of the blade 50 that is the reference attitude is an inclination in which the blade 50 is inclined furthest toward the rear.

The travel device 30 supports the vehicle body 10. The travel device 30 has a pair of crawlers 31 and a pair of sprocket wheels 32. The pair of crawlers 31 are rotated by the pair of sprocket wheels 32.

The pair of lift frames 40 are disposed on both outer sides of the pair of crawlers 31 so that the vehicle body 10 is disposed between the pair of lift frames 40. The pair of lift frames 40 includes a right lift frame 41 and a left lift frame 42 as illustrated in FIG. 2. The rear end parts of the pair of lift frames 40 are attached in a rotatable manner on both outer sides of the travel device 30. The front end parts of the pair of lift frames 40 are coupled to the blade 50.

The blade 50 is disposed in front of the vehicle body 10. The blade 50 is supported by the pair of lift frames 40, the pair of lift cylinders 60, and the pair of pitch/tilt cylinders 70. The blade 50 is lowered and raised by the pair of lift cylinders 60. The blade 50 is tilted forward and backward and left and right by the pair of pitch/tilt cylinders 70. Cutting edges 51 are attached at the lower end part of the blade 50 for digging into the ground when excavating or grading.

The pair of lift cylinders 60 is coupled to the vehicle body 10 and the blade 50. The pair of lift cylinders 60 include a right lift cylinder 61 and a left lift cylinder 62 as illustrated in FIG. 2. The blade 50 is lowered or raised due to simultaneous extension or retraction of the right lift cylinder 61 and the left lift cylinder 62 actuated by operating fluid.

As illustrated in FIG. 1, a pair of lift stroke sensors 63 is attached to the pair of lift cylinders 60. The pair of lift stroke sensors 63 each has a rotating roller for detecting the position of the cylinder rod, and a magnetic sensor for returning the cylinder rod to a home position. The pair of lift stroke sensors 63 detects the stroke amount of the right lift cylinder 61 (referred to as "right lift stroke amount 61S") and the stroke amount of the left lift cylinder 62 (referred to as "left lift stroke amount 62S"). The stroke amount herein refers to a movement amount of the cylinder rod from the state where the cylinder rod is contracted the most. The end parts of the lift cylinder 60 are coupled to the vehicle body 10 and the blade 50, and the position of the lift cylinder 60 is detected by detecting the stroke amount.

The pair of pitch/tilt cylinders 70 is coupled to the pair of lift frames 40 and the blade 50. The pair of pitch/tilt cylinders 70 includes a right pitch cylinder 71 and a left pitch/tilt cylinder 72 as illustrated in FIG. 2. The blade 50 is tilted forward and backward due to the right pitch cylinder 71 and the left pitch/tilt cylinder 72 being simultaneously extended and retracted at the same speed. The tilting action of a blade in the front-back direction is called a pitch action. Specifically, the blade 50 is tilted forward when the right pitch cylinder 71 and the left pitch/tilt cylinder 72 are both extended, and the blade 50 is tilted backward when the right pitch cylinder 71 and the left pitch/tilt cylinder 72 are both retracted.

The left side of the blade 50 is moved substantially up or down due to the extension or retraction of only the left pitch/tilt cylinder 72 while the right pitch cylinder 71 is not extended or retracted. Specifically, the blade 50 is tilted to the right when only the left pitch/tilt cylinder 72 is extended, and the blade 50 is tilted to the left when only the left pitch/tilt cylinder 72 is retracted. The action of tilting the blade 50 in the right-left direction is referred to as a tilting action. When the blade 50 is tilted in the right-left direction due to the tilting action, a difference in the stroke amounts between the right lift cylinder 61 and the left lift cylinder 62 is generated and the cylinder positions are no longer parallel. The stroke amounts of the right lift cylinder 61 and the left lift cylinder 62 become equal and the cylinder positions become parallel when the blade 50 is in a position of not being tilted to the right or left.

When the cylinder positions are parallel, the right lift cylinder 61 and the left lift cylinder 62 lie in the same plane and the shaft centers of the right lift cylinder 61 and the left lift cylinder 62 do not cross each other. Conversely, when the cylinder positions are non-parallel, the right lift cylinder 61 and the left lift cylinder 62 do not lie in the same plane and the shaft centers of the right lift cylinder 61 and the left lift cylinder 62 do not intersect.

FIGS. 3A to 3D are schematic views of configurations of the right lift cylinder 61, the left lift cylinder 62, the right pitch cylinder 71, and the left pitch/tilt cylinder 72. The states of each cylinder when the blade 50 is moved to the reference attitude are illustrated in FIGS. 3A to 3D. In the following explanation, the positions of the cylinders when the blade 50 is in the reference attitude are referred to as "reference positions".

Figure 3A:
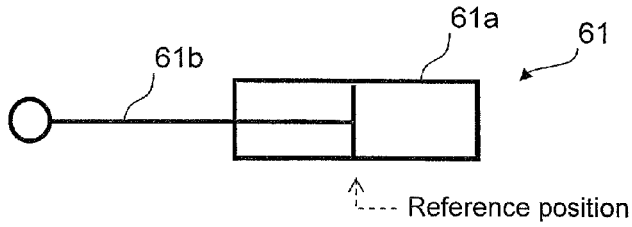
FIG. 3A is a schematic view of a configuration of a pair of lift cylinders and a pair of pitch/tilt cylinders according to the first embodiment.
Figure 3B:
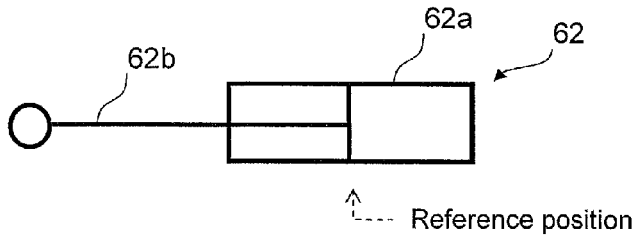
FIG. 3B is a schematic view of a configuration of a pair of lift cylinders and a pair of pitch/tilt cylinders according to the first embodiment.

As illustrated in FIGS. 3A and 3B, the right lift cylinder 61 and the left lift cylinder 62 have the same configurations. Specifically, a cylinder body 61*a* and a rod 61*b* of the right lift cylinder 61 are similar to a cylinder body 62*a* and a rod 62*b* of the left lift cylinder 62. The reference position of the right lift cylinder 61 is set to be near the center of the cylinder body 61*a* as illustrated in FIG. 3A. The reference position of the left lift cylinder 62 is set to be near the center of the cylinder body 62*a* as illustrated in FIG. 3B.

Figure 3C:
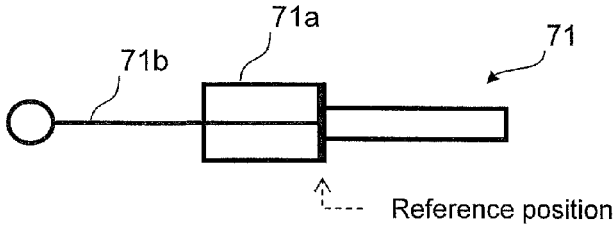
FIG. 3C is a schematic view of a configuration of a pair of lift cylinders and a pair of pitch/tilt cylinders according to the first embodiment.
Figure 3D:
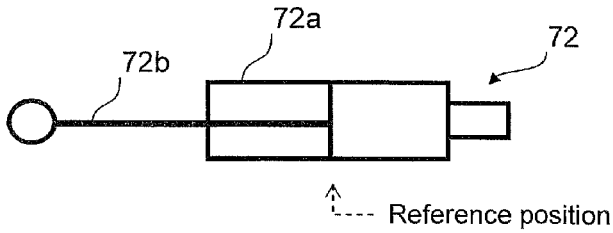
FIG. 3D is a schematic view of a configuration of a pair of lift cylinders and a pair of pitch/tilt cylinders according to the first embodiment.

In contrast, the right pitch cylinder 71 and the left pitch/tilt cylinder 72 have different configurations as illustrated in FIGS. 3C and 3D. Specifically, a cylinder body 71*a* of the right pitch cylinder 71 is shorter than a cylinder body 72*a* of the left pitch/tilt cylinder 72. As a result, the maximum stroke length in the cylinder body 71*a* is approximately half of the maximum stroke length in the cylinder body 72*a*. A rod 71*b* of the right pitch cylinder 71 is similar to a rod 72*b* of the left pitch/tilt cylinder 72. The reference position of the rod 71*b* of the right pitch cylinder 71 is set to be at the proximal end of the cylinder body 61*a* as illustrated in FIG. 3C. The reference position of the rod 72*b* of the left pitch/tilt cylinder 72 is set to be near the center of the cylinder body 72*a* in line with the right pitch cylinder 71 as illustrated in FIG. 3D.

The cylinder body 71*a* is shorter than the cylinder body 72*a* in order to restrict the fore-and-aft pitch angle so that the lower edge of the blade 50 does not dig into the ground surface while maintaining a sufficient stroke amount of the left pitch/tilt cylinder 72 to allow for tilting of the blade 50 to the right or left.

(Configuration of Blade Control System 200)

Figure 4:
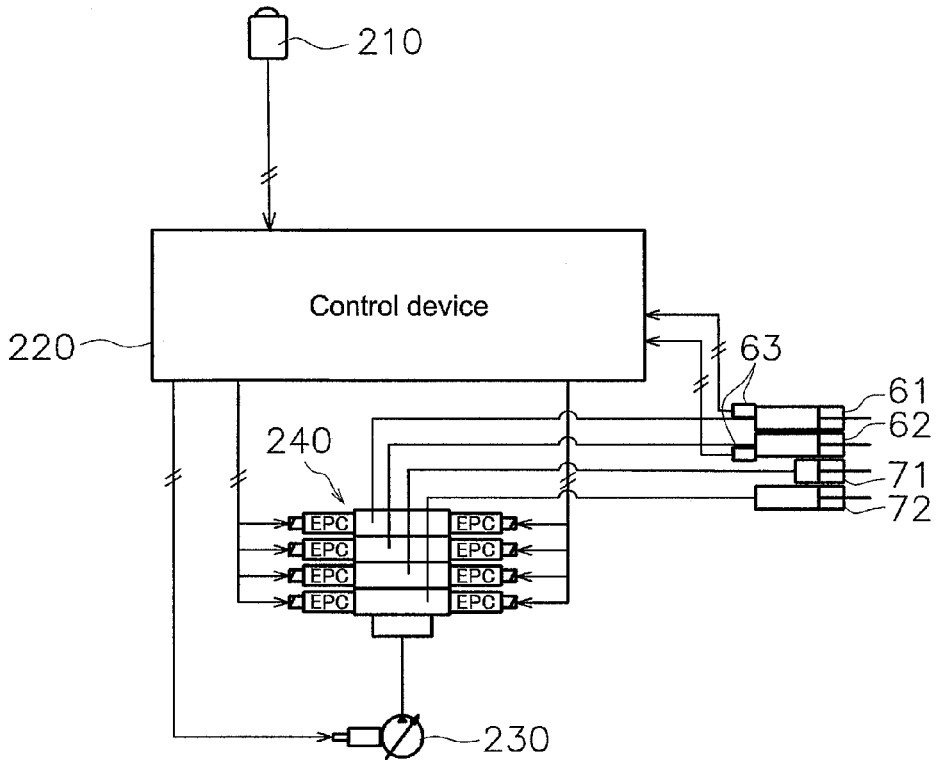
FIG. 4 is a block diagram of a configuration of a blade control system according to the first embodiment.
Figure 5A:
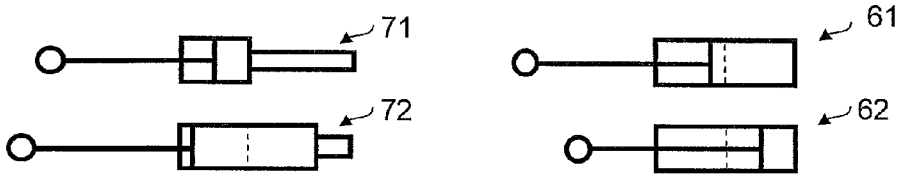
FIG. 5A is a schematic view illustrating a state of the actuation of the pair of lift cylinders and the pair of pitch/tilt according to the first embodiment.
Figure 5B:
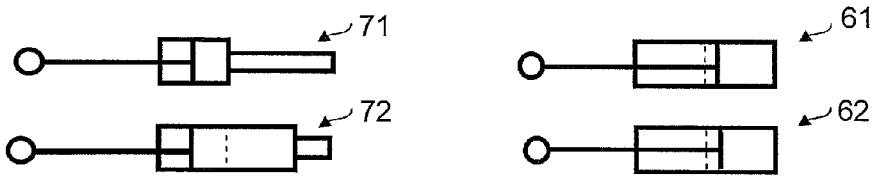
FIG. 5B is a schematic view illustrating a state of the actuation of the pair of lift cylinders and the pair of pitch/tilt cylinders according to the first embodiment.
Figure 5C:
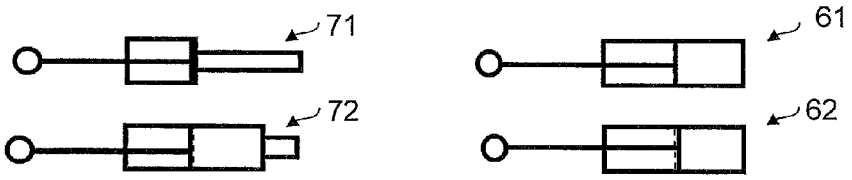
FIG. 5C is a schematic view illustrating a state of the actuation of the pair of lift cylinders and the pair of pitch/tilt cylinders according to the first embodiment.

The following is a discussion of the configuration of the blade control system 200 installed in the bulldozer 100 with reference to the drawings. FIG. 4 is a block diagram illustrating the configuration of the blade control system 200. FIGS. 5A to 5C are schematic views illustrating states of the actuations of the pair of lift cylinders 60 and the pair of pitch/tilt cylinders 70. The dashed lines in FIGS. 5A to 5C represent the reference positions of the hydraulic cylinders.

As illustrated in FIG. 4, the blade control system 200 is provided with the pair of lift cylinders 60, the pair of lift stroke sensors 63, the pair of pitch/tilt cylinders 70, the blade attitude restore button 210, a control device 220, a hydraulic pump 230, and main valves 240. The pair of lift cylinders 60 includes the right lift cylinder 61 and the left lift cylinder 62. The pair of pitch/tilt cylinders 70 includes the right pitch cylinder 71 and the left pitch/tilt cylinder 72.

The blade attitude restore button 210 transmits a blade attitude restore signal to the control device 220 when pressed by the operator.

The control device 220 is able to individually supply operating fluid from the hydraulic pump 230 to the right lift cylinder 61, the left lift cylinder 62, the right pitch cylinder 71, and the left pitch/tilt cylinder 72 according to the transmission of control signals to the main valves 240. Specifically, the control device 220 is able to actuate the cylinders individually. The control device 220 executes "blade attitude restore control" to restore the blade 50 to the reference attitude in response to the blade attitude restore signal from the blade attitude restore button 210.

First, the control device 220 detects the right lift stroke amount 61S and the left lift stroke amount 62S on the basis of detection values from the pair of lift stroke sensors 63. Next, when the right lift stroke amount 61S and the left lift stroke amount 62S are different as illustrated in FIG. 5A, the control device 220 actuates only the left pitch/tilt cylinder 72 so that the two stroke amounts match. The control device 220 temporarily stops actuating the left pitch/tilt cylinder 72 at the point in time that the right lift stroke amount 61S and the left lift stroke amount 62S match as illustrated in FIG. 5B. The pair of lift cylinders 60 enters a parallel positional relationship when the left and right lift stroke amounts match. While the actuation of the left pitch/tilt cylinder 72 is temporarily stopped at this point in time in the present embodiment, the process may advance to the next step without stopping.

Next, the control device 220 starts actuating the right pitch cylinder 71 and the left pitch/tilt cylinder 72 at the same speed when the right lift stroke amount 61S and the left lift stroke amount 62S match. At this time, the control device 220 determines the magnitude relation between a prescribed threshold TH1 (e.g., 3 mm) and the difference in the right lift stroke amount 61S and the left lift stroke amount 62S (herein referred to as "stroke difference ΔS"). The control device 220 stops the right pitch cylinder 71 and the left pitch/tilt cylinder 72 when it is determined that the stroke difference ΔS is larger than the threshold TH1.

Operation of Control Device 220

Figure 6:
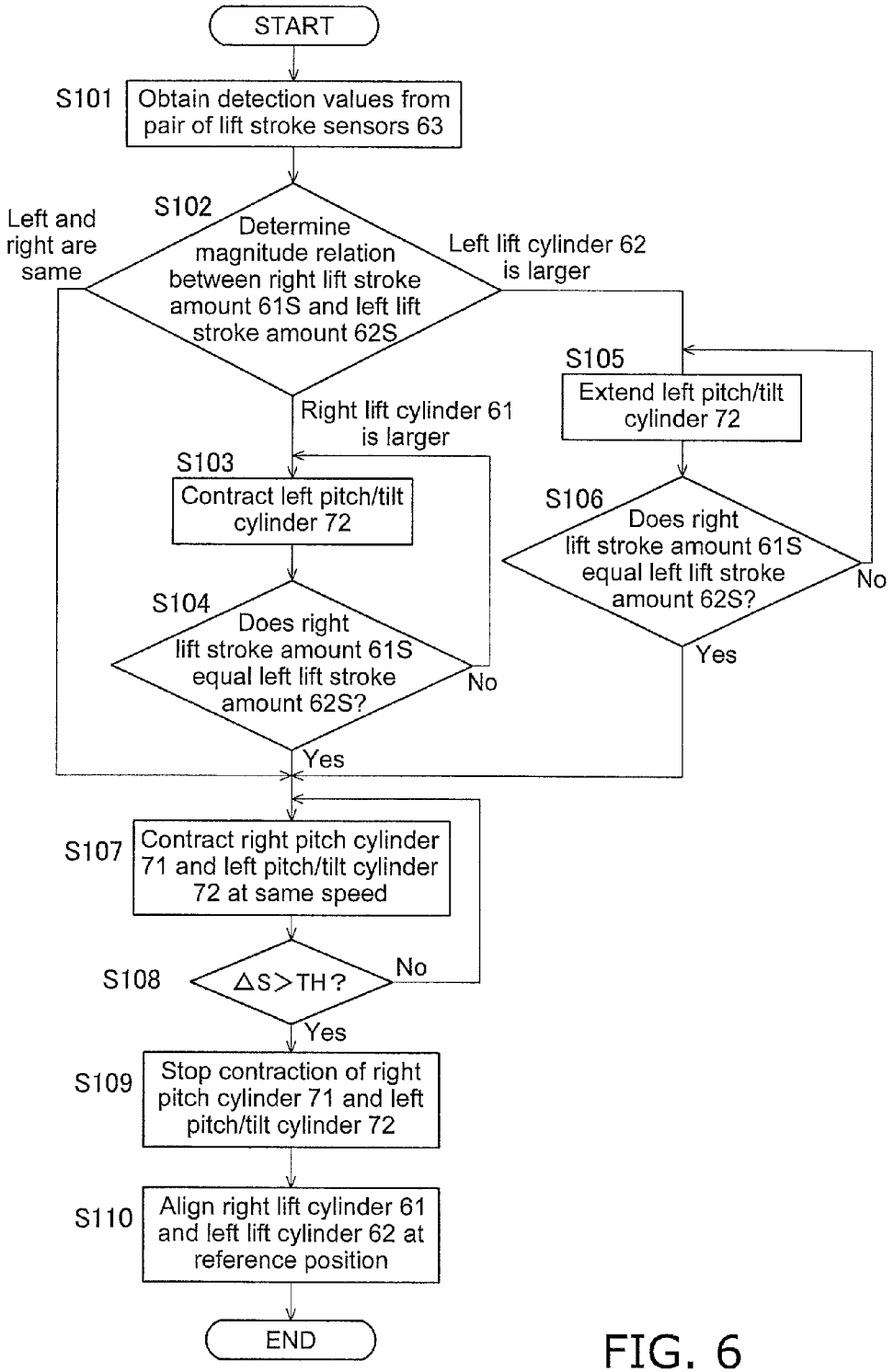
FIG. 6 is a flow chart for explaining blade orientation recovery control performed by a control device according to the first embodiment.

The following is an explanation of the blade attitude restore control performed by the control device 220 with reference to the drawings. FIG. 6 is a flow chart for explaining the blade attitude restore control performed by the control device 220. The blade attitude restore control is activated in response to the operator pressing the blade attitude restore button 210.

In step S101, the control device 220 obtains the detection values of the pair of lift stroke sensors 63.

In step S201, the control device 220 determines the magnitude relation between the right lift stroke amount 61S and the left lift stroke amount 62S on the basis of the detection values from the pair of lift stroke sensors 63.

If it is determined in step S102 that the right lift stroke amount 61S is larger than the left lift stroke amount 62S, the control device 220 retracts the left pitch/tilt cylinder 72 in step S103. At this time, the left lift stroke amount 62S gradually becomes larger due to the retraction of the left pitch/tilt cylinder 72 (see FIGS. 5A and 5B).

In step S104, the control device 220 determines whether the right lift stroke amount 61S and the left lift stroke amount 62S match while the left pitch/tilt cylinder 72 is being retracted. The control device 220 repeats steps S103 and S104 if the stroke amounts do not match, and the process advances to step S107 when both stroke amounts match. At the point in time that both stroke amounts match, the stroke amount of the right pitch cylinder 71 and the stroke amount of the left pitch/tilt cylinder 72 match (see FIG. 5B).

If it is determined in step S102 that the left lift stroke amount 62S is larger than the right lift stroke amount 61S, the control device 220 extends the left pitch/tilt cylinder 72 in step S105. At this time, the left lift stroke amount 62S gradually becomes smaller due to the extension of the left pitch/tilt cylinder 72 (see FIGS. 5A and 5B).

In step S106, the control device 220 determines whether the right lift stroke amount 61S and the left lift stroke amount 62S match while the left pitch/tilt cylinder 72 is being extended. The control device 220 repeats steps S105 and S106 if the stroke amounts do not match, and the process advances to step S107 when both stroke amounts match. At the point in time that both stroke amounts match, the stroke amount of the right pitch cylinder 71 and the stroke amount of the left pitch/tilt cylinder 72 match (see FIG. 5B) in the same way as in step S104.

In step S107, the control device 220 starts contracting the right pitch cylinder 71 and the left pitch/tilt cylinder 72 at the same speed when the right lift stroke amount 61S and the left lift stroke amount 62S match in steps S102, S104, and S106. When the right pitch cylinder 71 and the left pitch/tilt cylinder 72 are retracted at the same speed, the right lift stroke amount 61S and the left lift stroke amount 62S gradually become larger while maintaining the state of matching (see FIGS. 5B and 5C).

In step S108, the control device 220 determines whether the stroke difference ΔS of the right lift stroke amount 61S and the left lift stroke amount 62S is larger than the threshold TH1 (e.g., 3 mm). The control device 220 repeats the process in step S107 if the stroke difference ΔS is not larger than the threshold TH1, and the process advances to step S109 if the stroke difference ΔS is larger than the threshold TH1.

The stroke difference ΔS becomes larger than the threshold TH1 since the left lift stroke amount 62S becomes longer than the right lift stroke amount 61S due to the left pitch/tilt cylinder 72 continuing to retract even after the retraction of the right pitch cylinder 71 has stopped (see FIG. 5C). The retraction of the left pitch/tilt cylinder 72 is continued even after the retraction of the right pitch cylinder 71 has stopped since the maximum stroke length of the right pitch cylinder 71 is shorter than the maximum stroke length of the left pitch/tilt cylinder 72 as described above (see FIGS. 3C and 3D).

In step S109, the control device 220 stops the retraction of the right pitch cylinder 71 and the left pitch/tilt cylinder 72 when it is determined in step S108 that the stroke difference ΔS is larger than the threshold TH1. As a result, the blade 50 enters the state of having a certain pitch in the front-back direction without being substantially tilted in the right-left direction. Since the length of the lift cylinder 60 is several meters and thus much longer than the threshold TH1 (e.g., 3 mm), the pair of lift cylinders 60 are deemed to have a parallel positional relationship even if there is a stroke difference ΔS of about the same amount as the threshold TH1. In this way, "the pair of lift cylinders 60 are parallel" in the present embodiment is a concept that includes the stroke difference ΔS being about the same as the threshold TH1 and does not only include the stroke difference ΔS being "0".

In step S110, the control device 220 positions the rod 61*b* and the rod 62*b* at the reference position by actuating the right lift cylinder 61 and the left lift cylinder 62 at the same speed. As a result, the blade 50 is moved to a certain height above the ground surface.

Accordingly, the blade attitude restore control for restoring the blade 50 to the reference position is complete.

Characteristics

The control device 220 according to the first embodiment actuates the right pitch cylinder 71 and the left pitch/tilt cylinder 72 at the same speed when the right lift stroke amount 61S and the left lift stroke amount 62S match each other. Since the maximum stroke length of the right pitch cylinder 71 is larger than the maximum stroke length of the left pitch/tilt cylinder 72, the actuation of the left pitch/tilt cylinder 72 is able to continue even after the right pitch cylinder 71 has been stopped and thus the stroke difference ΔS becomes larger when only the left pitch/tilt cylinder 72 is actuated. The control device 220 stops the right pitch cylinder 71 and the left pitch/tilt cylinder 72 when it is determined that the stroke difference ΔS is larger than the threshold TH1.

Therefore, the blade 50 can be automatically returned to the reference attitude by actuating the pair of pitch/tilt cylinders 70 using only the pair of lift stroke sensors 63. As a result, cutting edges 51 of the blade 50 excessively digging into the ground surface or being positioned too far away from the ground surface can be suppressed. Consequently, excavation work can be executed effectively.

Second Embodiment

The following is an explanation of a bulldozer according to a second embodiment. The differences between the second embodiment and the first embodiment lie in the configuration of the pair of pitch/tilt cylinders and in the blade attitude restoration method. Therefore, the differences between the first and second embodiments will be mainly discussed below.

Configuration of Pair of Pitch/Tilt Cylinders 70A

Figure 7A:
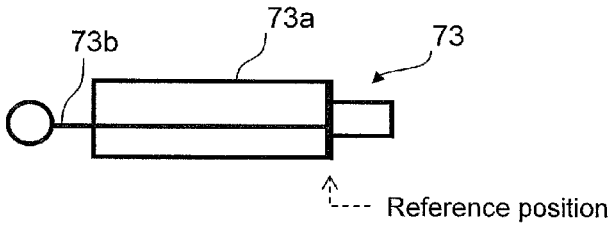
FIG. 7A is a schematic view of a configuration of the pair pitch/tilt cylinders according to the second embodiment.
Figure 7B:
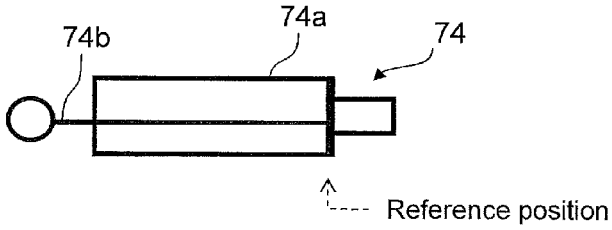
FIG. 7B is a schematic view of a configuration of the pair pitch/tilt cylinders according to the second embodiment.

A pair of pitch/tilt cylinders 70A according to the second embodiment includes a right pitch cylinder 73 and a left pitch/tilt cylinder 74. FIG. 7A is a schematic view of a configuration of the right pitch cylinder 73. FIG. 7B is a schematic view of a configuration of the left pitch/tilt cylinder 74. The states of each cylinder when the blade 50 is moved to the reference attitude are illustrated in FIGS. 7A and 7B.

As illustrated in FIGS. 7A and 7B, the right pitch cylinder 73 and the left pitch/tilt cylinder 74 have the same configurations. Specifically, a cylinder body 73*a* of the right pitch cylinder 73 has the same length as a cylinder body 74*a* of the left pitch/tilt cylinder 74. As a result, the maximum stroke length in the cylinder body 73*a* is the same as the maximum stroke length in the cylinder body 74*a*.

A rod 73*b* of the right pitch cylinder 73 has the same configuration as a rod 74*b* of the left pitch/tilt cylinder 74. The reference position of the rod 73*b* of the right pitch cylinder 73 is set to be at the proximal end of the cylinder body 73*a*. The reference position of the rod 74*b* of the left pitch/tilt cylinder 74 is set to be at the proximal end of the cylinder body 74*a* in line with the right pitch cylinder 73.

The configuration of the left pitch/tilt cylinder 74 is the same as the configuration of the left pitch/tilt cylinder 72 according to the first embodiment. The only difference between both configurations is the reference position.

Operation of Control Device 220A

Figure 8:
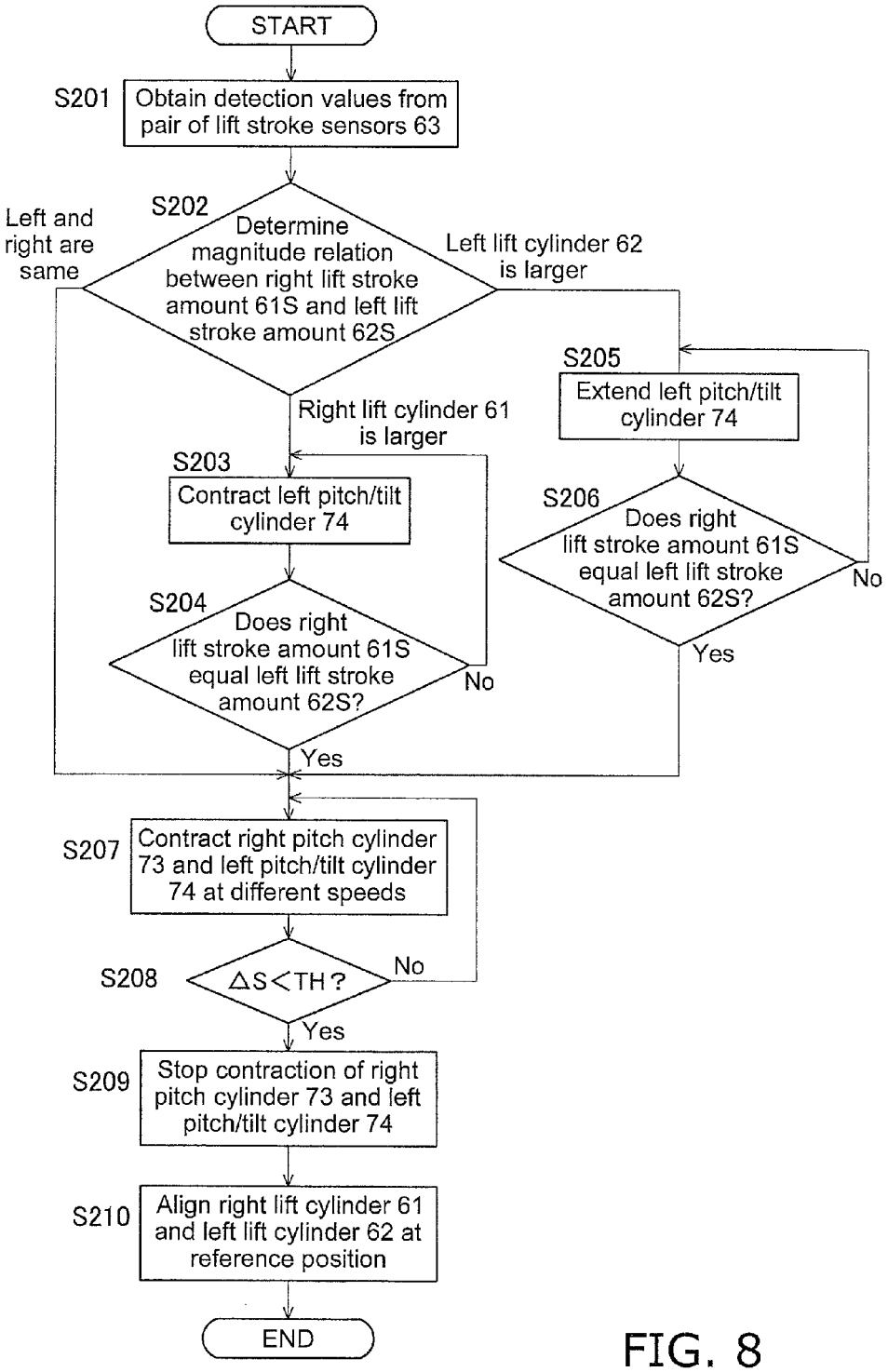
FIG. 8 is a flow chart for explaining blade orientation recovery control performed by a control device according to the second embodiment.

The following is an explanation of the blade attitude restore control performed by the control device 220A with reference to the drawings. FIG. 8 is a flow chart for explaining the blade attitude restore control performed by the control device 220A. FIGS. 9A to 9D are schematic views illustrating the states of actuation of the pair of lift cylinders 60 and the pair of pitch/tilt cylinders 70A.

In step S201, the control device 220A obtains the detection values of the pair of lift stroke sensors 63.

In step S202, the control device 220A determines the magnitude relation between the right lift stroke amount 61S and the left lift stroke amount 62S on the basis of the detection values from the pair of lift stroke sensors 63.

If it is determined in step S202 that the right lift stroke amount 61S is larger than the left lift stroke amount 62S, the control device 220 retracts the left pitch/tilt cylinder 74 in step S203. At this time, the left lift stroke amount 62S gradually becomes larger due to the retraction of the left pitch/tilt cylinder 74 (see FIGS. 9A and 9B).

In step S204, the control device 220A determines whether the right lift stroke amount 61S and the left lift stroke amount 62S match while the left pitch/tilt cylinder 74 is being retracted. The control device 220A repeats steps S203 and S204 if the stroke amounts do not match, and the process advances to step S207 when both stroke amounts match. At the point in time that both stroke amounts match, the stroke amount of the right pitch cylinder 73 and the stroke amount of the left pitch/tilt cylinder 74 match (see FIG. 9B).

If it is determined in step S202 that the left lift stroke amount 62S is larger than the right lift stroke amount 61S, the control device 220A extends the left pitch/tilt cylinder 74 in step S205. At this time, the left lift stroke amount 62S gradually becomes smaller due to the extension of the left pitch/tilt cylinder 74.

In step S206, the control device 220A determines whether the right lift stroke amount 61S and the left lift stroke amount 62S match while the left pitch/tilt cylinder 74 is being extended. The control device 220A repeats steps S205 and S206 if the stroke amounts do not match, and the process advances to step S207 when both stroke amounts match. At the point in time that both stroke amounts match, the stroke amount of the right pitch cylinder 73 and the stroke amount of the left pitch/tilt cylinder 74 match in the same way as in step S204 (see FIG. 9B).

In step S207, the control device 220A contracts the right pitch cylinder 73 and the left pitch/tilt cylinder 74 at different speeds when the right lift stroke amount 61S and the left lift stroke amount 62S match in steps S202, S204, and S206. When the right pitch cylinder 73 and the left pitch/tilt cylinder 74 are retracted at different speeds, the difference between the matching right lift stroke amount 61S and the left lift stroke amount 62S gradually becomes larger (see FIG. 9C).

In step S208, the control device 220A determines whether the stroke difference ΔS between the right lift stroke amount 61S and the left lift stroke amount 62S is smaller than a threshold TH2 (e.g., 3 mm). The control device 220 repeats the process in step S207 if the stroke difference ΔS is not smaller than the threshold TH2, and the process advances to step S209 if the stroke difference ΔS is smaller than the threshold TH2.

Figure 9A:
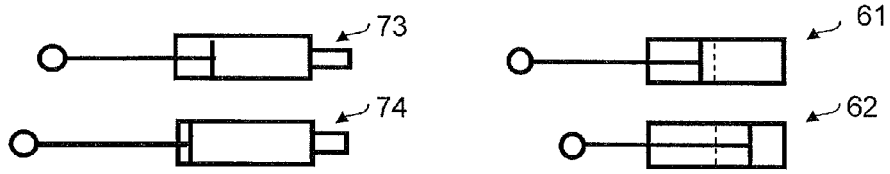
FIG. 9A is a schematic view illustrating a state of the actuation of the pair of lift cylinders and the pair of pitch/tilt cylinders according to the second embodiment.
Figure 9B:
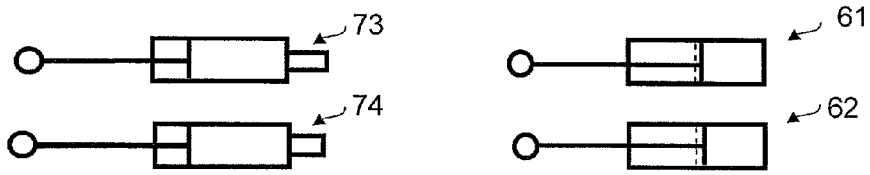
FIG. 9B is a schematic view illustrating a state of the actuation of the pair of lift cylinders and the pair of pitch/tilt cylinders according to the second embodiment.
Figure 9C:
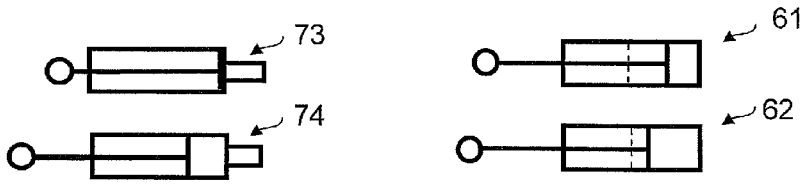
FIG. 9C is a schematic view illustrating a state of the actuation of the pair of lift cylinders and the pair of pitch/tilt cylinders according to the second embodiment.
Figure 9D:
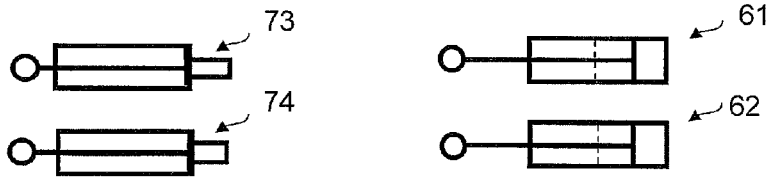
FIG. 9D is a schematic view illustrating a state of the actuation of the pair of lift cylinders and the pair of pitch/tilt cylinders according to the second embodiment.

The stroke difference ΔS becomes smaller than the threshold TH2 since the left lift stroke amount 62S approaches the right lift stroke amount 61S as illustrated in FIG. 9C due to the left pitch/tilt cylinder 74 continuing to retract even after the retraction of the right pitch cylinder 73 has stopped (see FIG. 9D). The retraction of the left pitch/tilt cylinder 74 is continued even after the retraction of the right pitch cylinder 73 has stopped since the left pitch/tilt cylinder 74 is retracted more slowly than the right pitch cylinder 73 as described above.

In step S209, the control device 220A stops the retraction of the right pitch cylinder 73 and the left pitch/tilt cylinder 74 when it is determined in step S208 that the stroke difference ΔS is smaller than the threshold TH2. As a result, the blade 50 enters the state of having a certain pitch in the front-back direction without being substantially tilted in the right-left direction. Since the length of the lift cylinder 60 is several meters and thus much longer than the threshold TH2 (e.g., 3 mm) in the present embodiment, the pair of lift cylinders 60 are deemed to have a parallel positional relationship even if there is a stroke difference ΔS of about the same amount as the threshold TH2. In this way, "the pair of lift cylinders 60 are parallel" in the present embodiment is a concept that includes the stroke difference ΔS being about the same as the threshold TH2 and does not only include the stroke difference ΔS being "0".

In step S210, the control device 220A positions the rod 61*b* and the rod 62*b* at the reference position by actuating the right lift cylinder 61 and the left lift cylinder 62 at the same speed. As a result, the blade 50 is raised to a certain height above the ground surface.

Accordingly, the blade attitude restore control for restoring the blade 50 to the reference position is complete.

Characteristics

The control device 220A according to the second embodiment actuates the right pitch cylinder 73 and the left pitch/tilt cylinder 74 at different speeds when the right lift stroke amount 61S and the left lift stroke amount 62S match each other. Since the maximum stroke length of the right pitch cylinder 73 is the same as the maximum stroke length of the left pitch/tilt cylinder 74, the stroke difference ΔS becomes smaller by actuating only the left pitch/tilt cylinder 74 after the right pitch cylinder 73 is stopped. The control device 220A stops the right pitch cylinder 73 and the left pitch/tilt cylinder 74 when it is determined that the stroke difference ΔS is smaller than the threshold TH2.

Therefore, the blade 50 can be returned to the reference attitude by actuating the pair of pitch/tilt cylinders 70A using only the pair of lift stroke sensors 63. As a result, cutting edges 51 of the blade 50 excessively digging into the ground surface or being positioned too far away from the ground surface can be suppressed. Consequently, excavation work can be executed effectively.

Other Embodiments

While the present invention has been described with the embodiments provided above, the description and drawings form a portion of the disclosure and are not to be understood as limiting the invention. Various substitutions, embodiments, and operation techniques will be apparent to those skilled in the art.

(A) While the reference positions of the right pitch cylinders 71 and 73 in the above embodiments are set to the respective proximal ends of the cylinder bodies 71*a* and 73*a*, the reference positions are not limited as such. The reference positions of the right pitch cylinders 71 and 73 may be set to the distal ends of the respective cylinder bodies 71*a* and 73*a*. Specifically, the reference positions of the right pitch cylinders 71 and 73 may be set to either end of the respective cylinder bodies 71*a* and 73*a*. In this case, the retraction in steps S103, S105 and S107 in FIG. 6 is replaced by extension, and the retraction in steps S203, S205 and S207 in FIG. 8 is replaced by extension.

(B) While the reference positions of the right pitch cylinders 71 and 73 in the above embodiments are set to the respective proximal ends of the cylinder bodies 71*a* and 73*a*, the reference positions are not limited as such. The reference positions of the right pitch cylinders 71 and 73 may be set to a certain position between the distal ends and the proximal ends of the respective cylinder bodies 71*a* and 73*a*. In this case, a pitch action of a certain amount in the direction opposite that of the pitch action described in the flow charts may be performed after the completion of the flows of the above embodiments.

(C) While the bulldozer 100 has been exemplified as a work machine in the above embodiments, a motor grader and the like may be exemplified as the work machine.

(D) While the right pitch cylinder 73 and the left pitch/tilt cylinder 74 are retracted at different speeds in the above second embodiment, the second embodiment is not limited as such. The right pitch cylinder 73 and the left pitch/tilt cylinder 74 may be contracted at the same speed even if the maximum stroke lengths of the right pitch cylinder 73 and the left pitch/tilt cylinder 74 are the same. In this case, a pressure sensor may be provided for detecting the relief pressures of the right pitch cylinder 73 and the left pitch/tilt cylinder 74 so that the restoration of the right pitch cylinder 73 and the left pitch/tilt cylinder 74 to the reference position can be detected using the generation of relief pressure in both cylinders. Therefore, the control device 220A in this case does not need to detect whether the stroke difference ΔS is smaller than the threshold TH2.

What is claimed is:

1. A work machine comprising:

a vehicle body;

a blade supported by the vehicle body;

a pair of first hydraulic cylinders configured to lower and raise the blade;

a pair of second hydraulic cylinders configured to tilt the blade forward and backward and left and right;

a pair of lift stroke sensors configured to detect stroke amounts from the pair of first hydraulic cylinders, respectively; and a control unit configured to start actuating the pair of second hydraulic cylinders when the stroke amounts of the pair of first hydraulic cylinders match, the control unit being configured to stop actuating the pair of second hydraulic cylinders based on a magnitude relation between a prescribed threshold and a difference in the stroke amounts of the pair of first hydraulic cylinders.

2. The work machine according to claim 1, wherein the pair of second hydraulic cylinders includes a pitch cylinder configured to tilt the blade forward and backward, and a pitch/tilt cylinder configured to tilt the blade forward and backward and left and right, a maximum stroke length of the pitch cylinder is shorter than a maximum stroke length of the pitch/tilt cylinder, and the control unit is configured to stop actuating the pair of second hydraulic cylinders when the control unit has determined that the difference between the stroke amounts of the pair of first hydraulic cylinders has become larger than the prescribed threshold while the pair of second hydraulic cylinders are being actuated at a same speed.

3. The work machine according to claim 1, wherein the pair of second hydraulic cylinders includes a pitch cylinder configured to pitch the blade forward and backward, and a pitch/tilt cylinder configured to tilt the blade forward and backward and left and right, a maximum stroke length of the pitch cylinder is the same as a maximum stroke length of the pitch/tilt cylinder, and the control unit is configured to stop actuating the pair of second hydraulic cylinders when the control unit has determined that the difference between the stroke amounts of the pair of first hydraulic cylinders has become smaller than the prescribed threshold while the pair of second hydraulic cylinders are being actuated at different speeds.

4. An automatic control method for a blade of a work machine having the blade that is lowered and raised by a pair of first hydraulic cylinders, the automatic control method comprising:

detecting positions of the pair of first hydraulic cylinders;

comparing the detected positions of the pair of first hydraulic cylinders;

tilting the blade until the pair of first hydraulic cylinders becomes parallel; and pitching the blade until the pair of first hydraulic cylinders becomes non-parallel after the blade has been tilted until the pair of first hydraulic cylinders becomes parallel.

5. An automatic control method for a blade of a work machine having the blade that is lowered and raised by a pair of first hydraulic cylinders and that is tilted forward and backward and right and left by a pair of second hydraulic cylinders, the automatic control method comprising:

detecting positions of the pair of first hydraulic cylinders;

comparing the detected positions of the pair of first hydraulic cylinders;

tilting the blade until the pair of first hydraulic cylinders becomes parallel; and stopping the pair of second hydraulic cylinders when the pair of first hydraulic cylinders has become parallel again while the pair of second hydraulic cylinders are being actuated at different speeds after the blade has been tilted until the pair of first hydraulic cylinders becomes parallel.

* * * * *